US005893264A

United States Patent [19]

Stahlecker

[11] Patent Number: 5,893,264

[45] Date of Patent: Apr. 13, 1999

[54] OPEN-END SPINNING ROTOR WITH A FIBER COLLECTING GROOVE AND METHOD OF MAKING SAME

[75] Inventor: Fritz Stahlecker, Josef-Neidhart Strasse 18, 73337 Bad Überkingen, Germany

[73] Assignees: Fritz Stahlecker, Bad Überkingen; Hans Stahlecker, Süssen, both of Germany

[21] Appl. No.: 08/975,225

[22] Filed: Nov. 21, 1997

[30] Foreign Application Priority Data

Dec. 11, 1996 [DE] Germany ..... 196 51 419

[51] Int. Cl.[6] ..... D01H 4/00

[52] U.S. Cl. ..... 57/416; 57/404; 57/414; 57/415

[58] Field of Search ..... 57/404, 414, 415, 57/416; 219/121.6, 121.61

[56] References Cited

U.S. PATENT DOCUMENTS

| | | | |
|---|---|---|---|
| 4,502,273 | 3/1985 | Miyamoto et al. | 57/414 |
| 4,662,170 | 5/1987 | Raasch | 57/416 |
| 4,663,929 | 5/1987 | Raasch et al. | 57/416 |
| 4,866,927 | 9/1989 | Fetzer et al. | 57/416 |
| 5,718,110 | 2/1998 | Stahlecker | 57/416 |

FOREIGN PATENT DOCUMENTS

| | | | |
|---|---|---|---|
| 2757656A1 | 6/1979 | Germany . | |
| 19509742A1 | 9/1996 | Germany . | |
| 4-.43722 | 11/1992 | Japan | 57/416 |
| 2075071 | 4/1980 | United Kingdom | 57/417 |

*Primary Examiner*—William Stryjewski
*Attorney, Agent, or Firm*—Evenson McKeown Edwards & Lenahan, PLLC

[57] ABSTRACT

An open-end spinning rotor has a fiber collecting groove which is provided with fine roughenings. The fiber collecting groove includes additional profilings whose peak-to-valley height is at least five times the peak-to-valley height of the roughenings. This arrangement results in an improvement in yarn quality.

23 Claims, 3 Drawing Sheets

OPEN-END SPINNING ROTOR WITH A FIBER COLLECTING GROOVE AND METHOD OF MAKING SAME

BACKGROUND AND SUMMARY OF THE INVENTION

This application claims the priority of German application 196 51 419.3 filed in Germany on Dec. 11, 1996, the disclosure of which is expressly incorporated by reference herein.

The present invention relates to an open-end spinning rotor comprising a sliding surface and a fiber collecting groove whose surface has fine roughenings.

An open-end spinning rotor described in German published patent application 195 09 742 A1 comprises a fiber collecting groove, which has fine roughenings in the micrometer range. In order to produce the roughenings, lasers are preferably used. A roughened surface is hereby produced which has the character of a wrinkled surface. The collecting groove obtains a favorable grip, which results in an improvement in the yarn. In order to increase the wear resistance, the surface of the fiber collecting groove is additionally boronized.

An open-end spinning rotor described in German published patent application 27 57 656 A1 has a sliding surface comprises wavelike profilings. The wave crests formed therefrom are equidistant to one another and have the same wave height. The fiber collecting groove is also preferably wave-shaped. The effective length of the fiber collecting groove is hereby increased, so that in particular long fibers can be deposited without any difficulties. The applicable area of the open-end spinning rotor is thus increased in relation to the staple length. The increase in the effective length is preferably 20%.

It is known from the U.S. Pat. No. 4,502,273 that in order to improve the wear resistance of the fiber collecting groove, an open-end spinning rotor made of steel is hardened by means of lasers. As the hardening can be localized very precisely, material distortion, which can otherwise occur during heat treatment, is avoided.

It is an object of the present invention to design the fiber collecting groove of an open-end spinning rotor in such a way that yarn quality is further improved.

This object has been achieved in accordance with the present invention in that the fiber collecting groove comprises profilings whose peak-to-valley height is at least five times the peak-to-valley height of the roughenings.

It has been shown that just that combination of relatively coarse profilings and fine roughenings result in an improvement in yarn quality. The improvement in yarn quality is marked by a higher yarn strength and a better evenness of the yarn. The fine roughenings ensure that the fibers arriving in the fiber collecting groove take up the rotational speed thereof practically without slip, while the coarser profilings result in an extension of the so-called fiber-integration zone, that is, an extension of the zone in which the single yarn twist is continued in the fiber collecting groove.

In accordance with the concept of the present invention, the peak-to-valley height of the roughenings is in the micrometer range, e.g. about 5 to 8 μ. Accordingly, the peak-to-valley height of the profilings is at least 25 μ.

The profilings can be arranged in circumferential direction of the open-end spinning rotor at large distances to one another or directly adjacent to one another.

It is important that the profilings are arranged equidistant to one another, so that periodical discontinuities do not occur in the fiber collecting groove, which subsequently result in an undesirable moire effect in the fabric. It is furthermore favorable when the profilings are otherwise uniformly arranged or formed, for example, when they have at least approximately similarly dimensions. This results in a further improvement in yarn quality.

A smaller or larger amount of roughenings in the fiber collecting groove can be provided, according to the spinning conditions to which the open-end spinning rotor is adapted. The roughenings should be distributed over the entire circumference of the fiber collecting groove. In an advantageous way, such roughenings are contained on the surfaces of profilings, which roughenings partly or entirely cover the corresponding profilings.

In an advantageous embodiment of the present invention, the profilings form elevations and/or recesses, which extend transversely to the circumferential direction of the open-end spinning rotor. Transversely extending profilings of this type result in a further improvement in yarn quality, possibly because the extension of the single yarn twist into the fiber collecting groove is less hindered.

In an advantageous embodiment of the present invention, the profilings are arranged in a wave-like formation and form wave crests and wave troughs extending transversely to the circumferential direction of the open-end spinning rotor. Particularly good spinning results are achieved using a surface of this kind.

In a further advantageous embodiment of the present invention, the profilings are arranged in a honeycomb shape.

In an advantageous embodiment of the present invention, the fiber collecting groove is made of ceramic material. The surface form of the fiber collecting groove according to the present invention achieves good spinning results with this very wear-resistant material.

In a further advantageous embodiment of the present invention, the fiber collecting groove is made of boronized steel. It has been shown that the surface form according to the present invention achieves particularly good spinning results when the fiber collecting groove is boronized. At the same time, a long life for the fiber collecting groove is obtained. Even after many operational hours, the spinning results deteriorate only slightly due to the hardness of the surface. Thus the double requirement of good spinning properties and long life are both fulfilled. These requirements were seen up to now as mutually exclusive. It is practical for the purposes of the present invention to apply the surface form to the already boronized collecting groove. This results in better yarn quality in comparison to collecting grooves which are boronized after the surface of the present invention has been applied.

The profilings and roughenings can be produced in various ways, for example by mechanical means. It is also possible to use material for the fiber collecting groove which already comprises the desired roughenings due to its inherent character.

In an advantageous embodiment of the present invention, the roughenings and profilings are produced by laser. It has been shown that the specific surface form obtained by means of lasers gives particularly good spinning results. A further advantage is that the laser settings can be adjusted very easily. Thus very varying surface forms of the fiber collecting groove can be obtained, according to the spinning specifications required. Lasers can be applied with good results to all materials used for open-end spinning rotors, in particular to hard materials, such as ceramic or iron boride.

In an advantageous way, the production of profilings and roughenings takes place in the same procedural step.

In an advantageous way, unhardened steel is used for the fiber collecting groove, which is hardened by means of lasers. This can take place, in an advantageous way, in the same procedural step in which the profilings and roughenings are produced by lasers. A good protection against wear can thus be obtained in a cost-effective way. In an advantageous embodiment, the fiber sliding surface also comprises profilings which are directed towards the fiber collecting groove. These profilings are also produced in an advantageous way by means of lasers.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
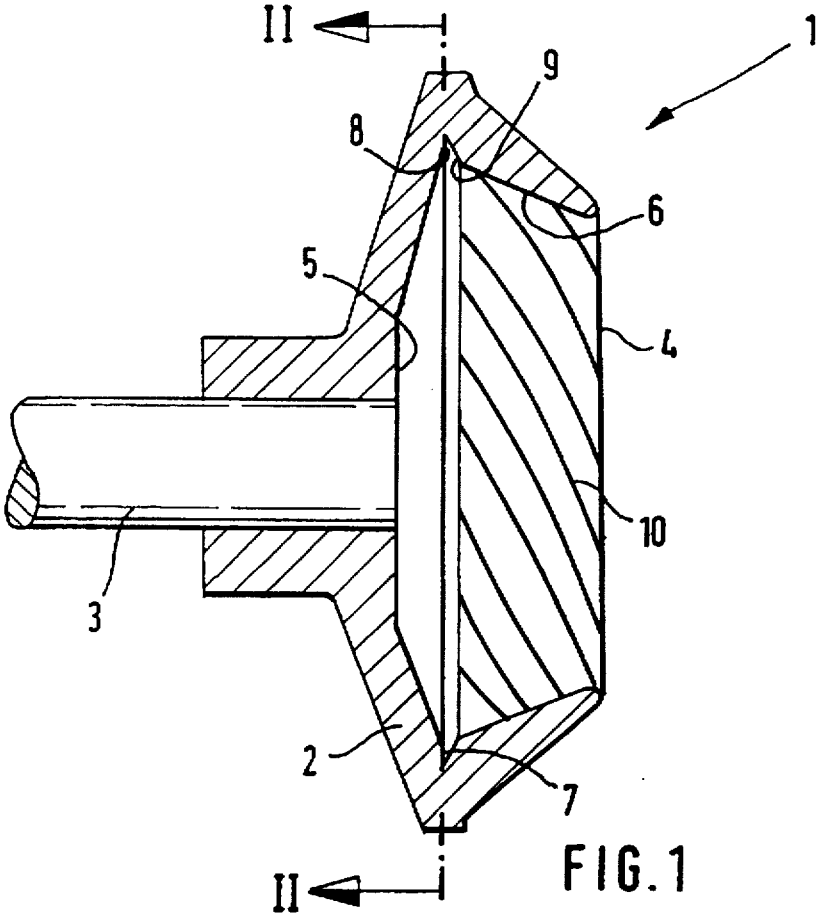
FIG. 1 is an axial section of an open-end spinning rotor, constructed according to preferred embodiments of the present invention.

The open-end spinning rotor 1 shown in FIG. 1 comprises a rotor cup 2 and a rotor shaft 3 tightly coupled thereto. For reasons of better wear resistance, the rotor cup 2 is provided on its inner side with a ceramic layer, or is made entirely of ceramic material. The rotor cup 2 comprises in a known way an inner chamber, which is accessible on one side through a rotor opening 4 and which is closed on the other side by means of a rotor bottom 5.

The inner chamber of the rotor cup 2 is conically widened where it adjoins the rotor opening 4. Its inner circumferential wall forms a fiber sliding surface 6 there.

The inner circumferential wall of the rotor cup 2 extends into a fiber collecting groove 7 after the fiber sliding surface 6. The fiber collecting groove 7 is V-shaped in cross section, so that two groove sides 8,9 are formed disposed opposite one another.

The fiber sliding surface 6 is provided with profilings 10, which start from the rotor opening 4 and are guided in circumferential direction of the fiber sliding surface 6 to the fiber collecting groove 7 with a direction component directed against the rotational direction of the open-end spinning rotor 1. The profilings 10, which are composed of groove-like recesses and adjacent web-like elevations are produced by means of lasers. Outside of the profilings 10, the surface of the fiber sliding surface 6 is smoothed. The profilings 10 serve to facilitate the transport of the fibers fed to the fiber sliding surface 6 to the fiber collecting groove 7. The profilings 10 can be omitted in many cases, in particular when the fiber sliding surface 6 is very conical.

Both groove sides 8 and 9 of the fiber collecting groove 7 are essentially identically formed. The following description of the groove side 8 applies also to the groove side 9.

Figure 2:
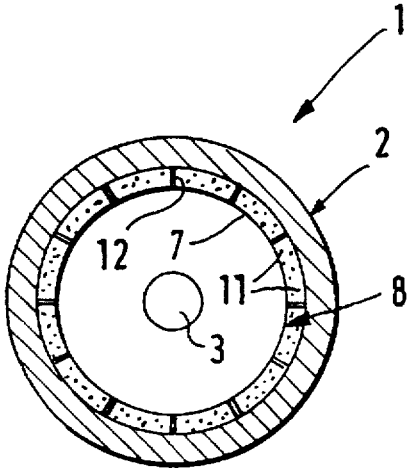
FIG. 2 is in reduced scale a sectional view along the line II—II of FIG. 1, showing a first embodiment of a fiber collecting groove.

As can be seen from FIG. 2, the surface of the fiber collecting groove 7 is provided with fine roughenings 11 in the micrometer range. Roughenings 11 serve to increase the roughness of the fiber collecting groove 7 and thus to improve the adherence of the fibers on the fiber collecting groove 7, so that the fibers take on the circumferential speed of the fiber collecting groove 7 in as far as possible without slip. In addition to these roughenings 11, the fiber collecting groove 7 comprises a plurality of profilings 12, which are arranged equidistant from one another in circumferential direction of the open-end spinning rotor 1. The profilings 12 are significantly coarser than the roughenings 11 wherein the peak-to-valley height of the profilings is at least five times the peak-to-valley height of the roughenings. Due to the arrangement of profilings 12 in addition to the roughenings 11, the spinning conditions inside the fiber collecting groove 7 are improved, probably because the single yarn twist is more easily transmitted into the fiber collecting groove 7, thereby extending the so-called fiber binding zone. This results directly in an improvement in yarn quality. The roughenings 11 as well as the profilings 12 are produced by means of lasers. By means of this production method, the roughenings 11 and the profilings 12 obtain a particular form, which has a favorable effect on yarn quality.

In the first embodiment shown in FIG. 2, the profilings 12 form a relatively wide, constant distance to one another. The uniformity of the distances has a favorable effect on the evenness of the yarn. Each profiling 12 is composed of at least one web-like elevation and one groove-like recess, which extend transversely to the circumferential direction of the open-end spinning rotor 1. The sections between two adjacent web-like elevations extend essentially level. They comprise fine roughenings 11 in the form of small material deposits (sprayed material), which occur during lasering. The roughenings 11 are irregularly formed and non-uniformly large. They do not, however, deviate too much from an average size. The roughenings 11 are arranged in circumferential direction at irregular distances to one another. They are, however, relatively regularly arranged over the entire circumference of the fiber collecting groove 7.

Figure 3:
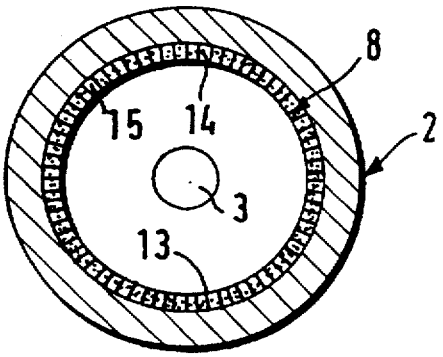
FIG. 3 shows a second embodiment of a fiber collecting groove, in a view similar to the depiction in FIG. 2.

The second embodiment of a fiber collecting groove 13 as shown in FIG. 3 comprises a wear resistant surface made of iron boride. A wear resistant surface of this type can, for example, be obtained in that a rotor cup 2 made of unhardened steel is boronized in the area of the fiber collecting groove 13. The fiber collecting groove 13 differs furthermore from the embodiment in FIG. 2 in that a larger number of profilings 14 are provided. The profilings 14 have the form of groove-like recesses and web-like elevations. They are arranged directly adjacent and at short, equal distances to one another. Roughenings 15 are distributed over the entire circumference of the fiber collecting groove 13, which roughenings 15 are significantly finer than the profilings 14. The profilings 14 and roughenings 15 are produced by means of laser on the boronized fiber collecting groove 13.

It would be possible in a further embodiment (not shown) to apply first the profilings 14 and roughenings 15 in the fiber collecting groove 13 and only then to give it the desired wear resistance by means of boronizing.

Figure 4:
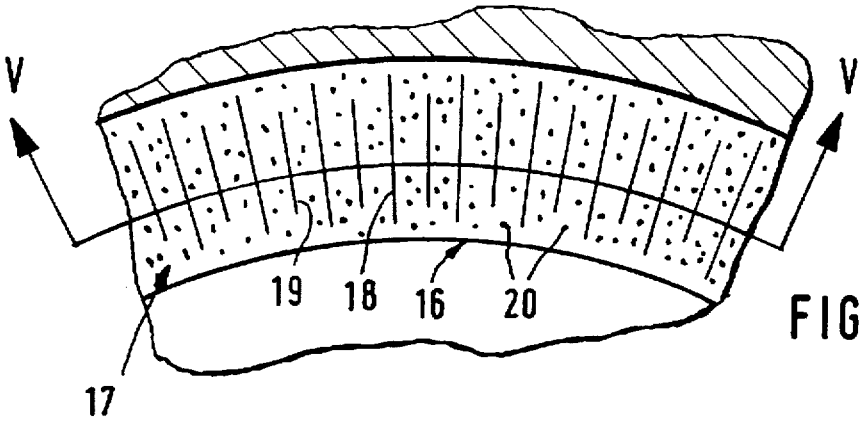
FIG. 4 is an enlarged part view of a third embodiment of a fiber collecting groove.
Figure 5:
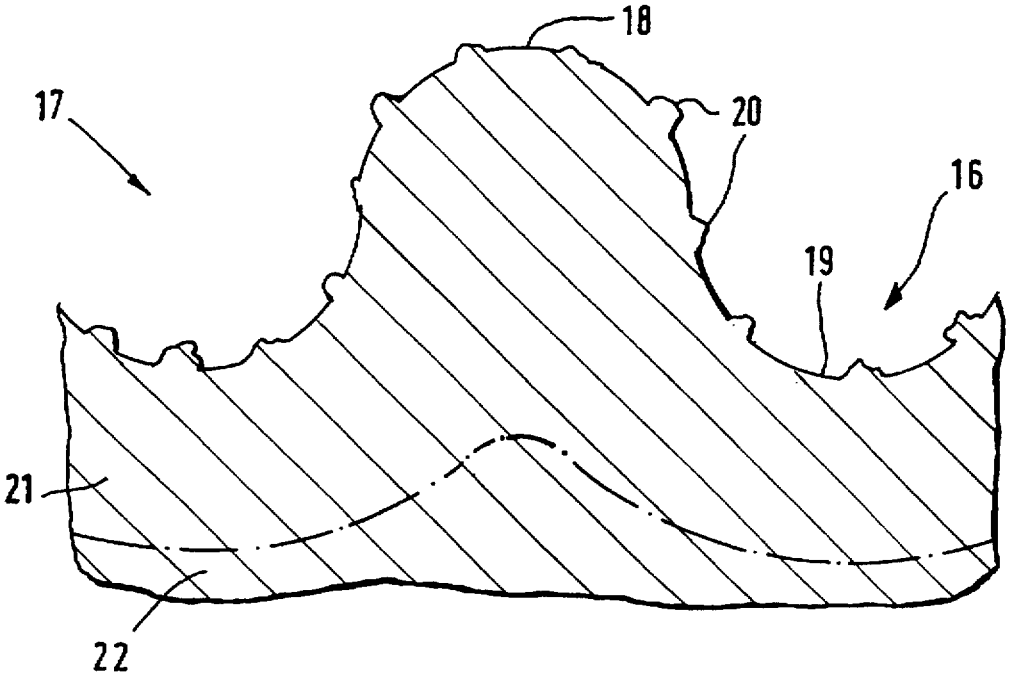
FIG. 5 is a greatly enlarged sectional view along the line V—V of FIG. 4.

In the case of the third embodiment as shown in FIGS. 4 and 5, profilings 17 are provided, which extended wave-like over the entire circumference of the fiber collecting groove 16. The wave crests 18 and the wave troughs 19 formed by the profilings are arranged transversely to the circumferential direction of the open-end spinning rotor 1. They are arranged at equal distances from one another, so that at no point on the circumference is there overlapping. They are at least approximately the same height. As can be seen in particular from FIG. 5, the profilings 17 are strewn with roughenings 20, which have the form of material deposits.

As indicated in FIG. 5, the fiber collecting groove 16 comprises on its surface a layer out of hardened steel 21. This layer is disposed over a layer of unhardened steel 22. The profilings 17 and the roughenings 20 are produced by means of lasers. The layer of hardened steel 21 is also produced by means of lasers from the unhardened steel 22. A rotor cup 2 made from unhardened steel can hereby be used, which can be produced cost-effectively. The production of the roughenings 20 and the profilings 17 as well as the hardening take place in a cost-effective manner in the same procedural step. This is described below.

The use of lasers has the further advantage, in addition to the above mentioned advantage of an improvement in the spinning properties, of reducing the costs for wear protection of the fiber collecting groove 16 by means of hardening.

Figure 6:
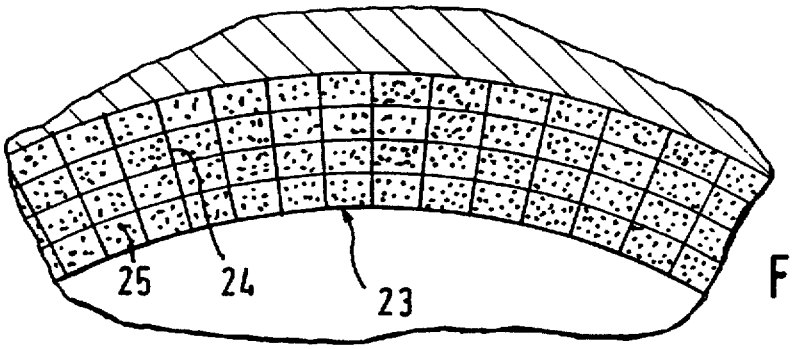
FIG. 6 is an enlarged part view of a fourth embodiment of a fiber collecting groove.

The fourth embodiment of a fiber collecting groove 23 shown in FIG. 6 differs from the other embodiments in that the profilings 24 are arranged in a honeycomb shape. Roughenings 25 are arranged between the profilings 24, which roughenings 25 are significantly finer than the profilings 24.

Figure 7:
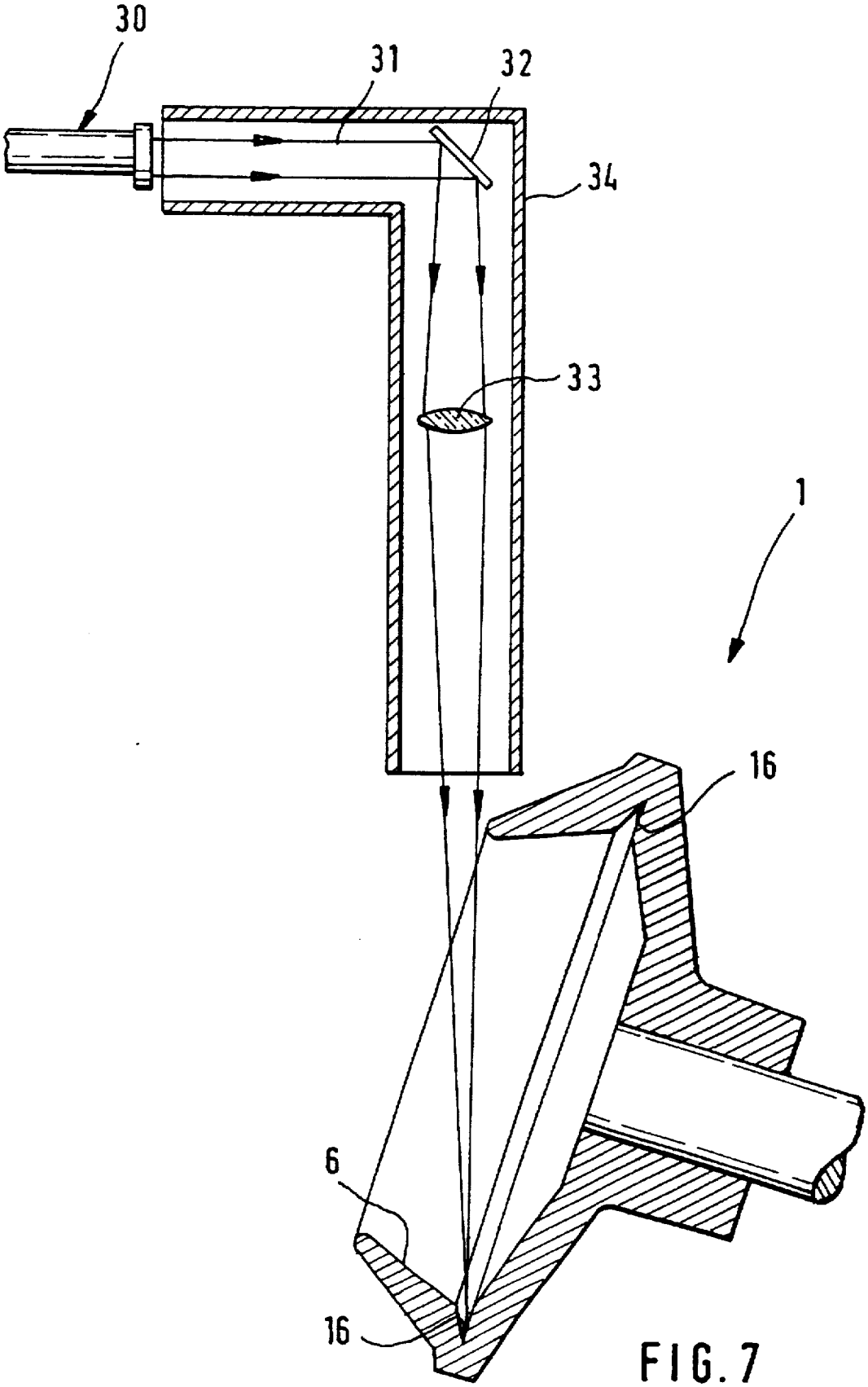
FIG. 7 illustrates the treating of a fiber collecting groove with lasers.

FIG. 7 shows a schematic representation of how the profilings 17 and the roughenings 20 on the fiber collecting groove 16 (see also FIGS. 4 and 5) are produced by means of lasers and how the hardening of the steel 22 in the fiber collecting groove 16 occurs by means of lasers.

A laser beam 31, surrounded by a protective tube 34, is directed from a laser 30 against the fiber collecting groove 16. The laser beam 31 is hereby deflected at a right angle by means of an angle reflector 32 and compressed by means of lens 33 to such a degree that the beam targets a point on the fiber collecting groove 16. During this process, the open-end spinning rotor 1 is stable, yet rotatably taken up in a holding device (not shown). During the laser process, the open-end spinning rotor 1 is rotated intermittently in dependence on the required duration of effect of the laser beam 31. The laser beam 31 can be directed at any desired point of the fiber collecting groove 16. By adjusting the laser 30, different variations of profilings 17 and roughenings 20 can be produced in one procedural step. As required, a mask can also be used in the case of the laser 30. The laser 30 is adjusted so that the localized hardening of the fiber collecting groove 16 can take place by means of the laser beam 31 at the same time as the producing of the profilings 17 and the roughenings 20.

It is also contemplated to produce the profilings 10 of the fiber sliding surface 6, without the open-end spinning rotor 1 having to be removed from the holding device.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning rotor comprising a fiber sliding surface and a fiber collecting groove, said fiber collecting groove having a groove surface formed with a plurality of profilings and a plurality of roughenings, wherein said profilings are formed as elevations defining profile peaks and recesses defining profile valleys between the profile peaks, said profilings exhibiting a predetermined profiling peak to valley height, wherein said roughenings are formed with respective roughening peaks and roughening valleys between the roughening peaks, said roughenings exhibiting a predetermined roughening peak to valley height, and wherein the profiling peak to valley height is at least five times the roughening peak to valley height.

2. An open-end spinning rotor according to claim 1, wherein the profilings are arranged equidistant to one another in a circumferential direction of the open-end spinning rotor.

3. An open-end spinning rotor according rotor according to claim 2, wherein surfaces of the profilings comprise the roughenings.

4. An open-end spinning rotor according to claim 3, wherein the profiling elevations and recesses extend transversely to the circumferential direction of the open-end spinning rotor.

5. An open-end spinning rotor according to claim 3, wherein the profilings are arranged wave-like and form wave crests and wave troughs extending transversely to the circumferential direction of the open-end spinning rotor.

6. An open-end spinning rotor according to claim 3, wherein the fiber collecting groove is made of ceramic material.

7. An open-end spinning rotor according to claim 3, wherein the fiber collecting groove is made of boronized steel.

8. An open-end spinning rotor according to claim 3, wherein the fiber collecting groove is made of steel hardened by laser beams.

9. An open-end spinning rotor according to claim 3, wherein the roughenings and the profilings are produced by means of laser beams.

10. An open-end spinning rotor according to claim 3, wherein the fiber sliding surface comprises profilings which are directed towards the fiber collecting groove.

11. An open-end spinning rotor according to claim 1, wherein surfaces of the profilings comprise the roughenings.

12. An open-end spinning rotor according to claim 1, wherein the profiling elevations and recesses extend transversely to a circumferential direction of the open-end spinning rotor.

13. An open-end spinning rotor according to claim 1, wherein the profilings are arranged wave-like and form wave crests and wave troughs extending transversely to the circumferential direction of the open-end spinning rotor.

14. An open-end spinning rotor according to claim 1, wherein the profilings are arranged in a honeycomb pattern.

15. An open-end spinning rotor according to claim 1, wherein the fiber collecting groove is made of ceramic material.

16. An open-end spinning rotor according to claim 1, wherein the fiber collecting groove is made of boronized steel.

17. An open-end spinning rotor according to claim 1, wherein the fiber collecting groove is made of steel hardened by laser beams.

18. An open-end spinning rotor according to claim 1, wherein the roughenings and the profilings are produced by means of laser beams.

19. An open-end spinning rotor according to claim 1, wherein the fiber sliding surface comprises profilings which are directed towards the fiber collecting groove.

20. An open-end spinning rotor according to claim 19, wherein the profilings of the fiber sliding surface are produced by means of lasers.

21. A method of making an open-end spinning rotor comprising a fiber sliding surface and a fiber collecting groove, said fiber collecting groove having a groove surface formed with a plurality of profilings and a plurality of roughenings, wherein said profilings are formed as elevations defining profile peaks and recesses defining profile valleys between the profile peaks, said profilings exhibiting a predetermined profiling peak to valley height, wherein said roughenings are formed with respective roughening peaks and roughening valleys between the roughening peaks, said roughenings exhibiting a predetermined roughening peak to valley height, and wherein the profiling peak to valley height is at least five times the roughening peak to valley height, said method comprising:

providing a rotor body with an interior defining a fiber sliding surface leading to a fiber collecting groove, directing a laser beam onto the fiber collecting groove in a predetermined pattern to form the profilings, and directing a laser beam onto the fiber collecting groove with the profilings to form the roughenings thereon.

22. A process according to claim 21, wherein the roughenings and profilings in said fiber collecting groove are made from unhardened steel, whereby the fiber collecting groove is hardened by said laser beam.

23. A process according to claim 21, wherein the production of the roughenings and the profilings and the hardening take place in the same procedural step.

* * * * *